United States Patent [19]

Wolf

[11] 3,944,465

[45] Mar. 16, 1976

[54] HEADBOX ASSEMBLY FOR A PAPERMAKING MACHINE

[75] Inventor: Karl Wolf, Heidenheim-Schnaitheim, Germany

[73] Assignee: E. I. Du Pont de Nemours and Company, Heidenheim(Brenz), Germany

[22] Filed: Apr. 22, 1974

[21] Appl. No.: 462,937

[30] Foreign Application Priority Data

Apr. 21, 1973 Germany ..... 2320312

[52] U.S. Cl. ..... 162/336; 162/347

[51] Int. Cl.[2] ..... D21F 1/06

[58] Field of Search ..... 162/336, 347, 212, 213, 162/338, 339, 341

[56] References Cited

UNITED STATES PATENTS 2,677,991 5/1954 Goumeniouk ..... 162/338

*Primary Examiner*—S. Leon Bashore
*Assistant Examiner*—Marc L. Caroff
*Attorney, Agent, or Firm*—Herbert L. Lerner

[57] ABSTRACT

Headbox assembly for a papermaking machine provided with a wire screen through which water from wet paper stock drains, the assembly including a headbox having a discharge nozzle for a jet of the paper stock, at least one forward and one rearward wedge member as viewed in feed direction of the stock jet from the discharge nozzle, the wedge member underlying the headbox and having respective wedge surfaces of different inclination, respective base members pivotally supporting the headbox and supportingly engaged by the wedge members respectively, a threaded spindle whereon the wedge members are mounted in common, the spindle being actuable for adjusting the position of the wedges forward and rearward of the stock feed direction and accordingly of the headbox whereby the discharge nozzle thereof is adjustable relative to the wire screen of the machine, and guide stop means engaging with the headbox as a brace for adjusting forces applied thereto.

5 Claims, 2 Drawing Figures

HEADBOX ASSEMBLY FOR A PAPERMAKING MACHINE

Figure 1:
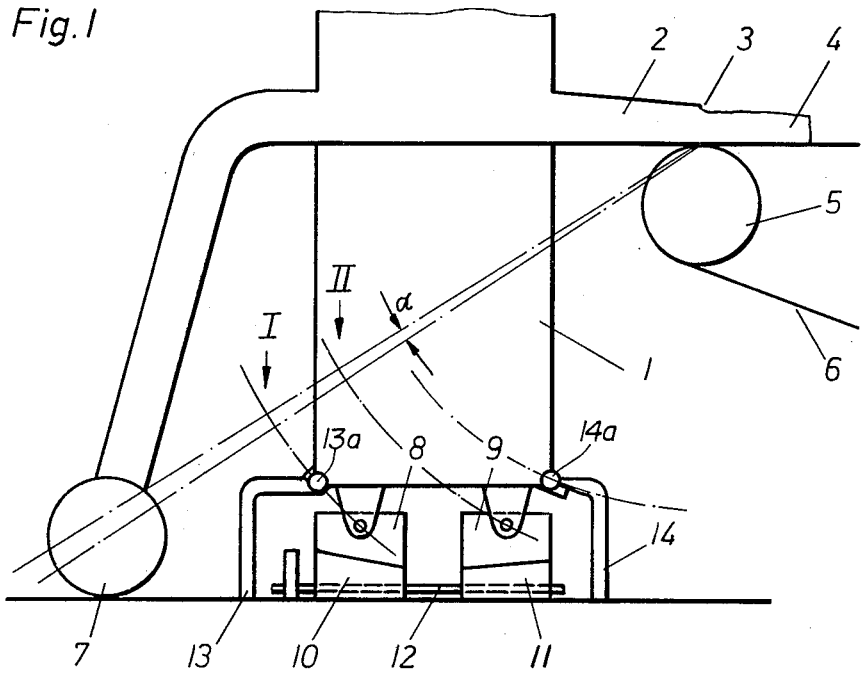

The invention relates to a headbox assembly for a papermaking machine, such as a fourdrinier machine and more particularly, to such a headbox assembly that has a discharge nozzle for a jet of the paper stock which is adjustable relative to a screen or so-called wire of the machine.

It has been known, heretofore, to provide a headbox having a stock jet that is adjustable by suitably shifting an inclined bottom lip plate of the discharge nozzle. While such an adjustment permits variation in the location of the point of impingement, the stock jet approach angle is not controllable thereby.

Adjustment of the jet approach angle is of importance, however, for different types of machines. Accurate alignment of the stock jet is often required in twin-wire machines. Space limitations, however, prohibit adjustment of the discharge nozzle. Varying of the stock jet approach angle may also become necessary in conventional fourdrinier machines.

It is accordingly an object of the invention to provide a headbox of the aforementioned type which can be swiveled about any optionally selected rotary axis.

With the foregoing and other objects in view, there is provided, in accordance with the invention, headbox assembly for a papermaking machine provided with a wire screen through which water from wet paper stock drains, the assembly comprising a headbox having a discharge nozzle for a jet of the paper stock, at least one forward and one rearward wedge member as viewed in feed direction of the stock jet from the discharge nozzle, said wedge members underlying said headbox and having respective wedge surfaces of different inclination, respective base members pivotally supporting said headbox and supportingly engaged by said wedge members respectively, a threaded spindle whereon said wedge members are mounted in common, said spindle being actuable for adjusting the position of said wedges forward and rearward of said stock feed direction and accordingly of said headbox whereby said discharge nozzle thereof is adjustable relative to the wire screen of the machine, and guide stop means engaging with said headbox as a brace for adjusting forces applied thereto.

The two wedge members enable the headbox to be swiveled about any desired axis extending in transverse direction of the elongated papermaking machine and determined by the inclination of the wedge surfaces of the wedge members and their particular location, so that a variation in the stock jet approach angle or adjustment of the point of impingement of the stock jet on the machine wire can be effected. With this construction, it is possible to use the same headbox for different installation conditions. Only the wedge members and the guide stop means would have to be differently constructed and/or disposed. The guide stop means thereby guides the headbox about the selected pivot center during the adjustment by the wedge members; thereby preventing lateral deviation or misalignment of the headbox.

In accordance with another feature of the invention, the guide stop means comprises at least one guide stop member located on a peripheral area disposed about a pivot center for the headbox. Due to this special configuration and disposition of the stop, the headbox is precisely guided during the swivel motion thereof and thereby assures accurate retention of the swivel axis, thus consequently assuring a precise jet adjustment.

In accordance with a further feature of the invention, the respective inclination of the wedge members and the pitch of respective sections of the threaded spindle associated with the wedge members are in different directions. Additional guidance of the headbox during adjustment can thereby be dispensed with.

Other features which are considered as characteristic for the invention are set forth in the appended claims.

Although the invention is illustrated and described herein as headbox assembly for a papermaking machine, it is nevertheless not intended to be limited to the details shown, since various modifications may be made therein without departing from the spirit of the invention and within the scope and range of equivalents of the claims.

Figure 2:
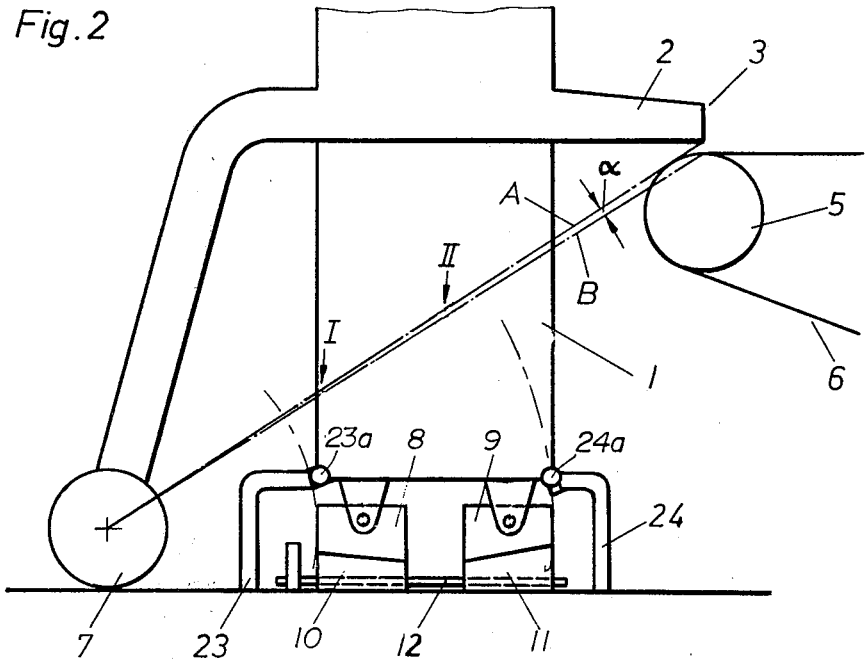

The invention, however, together with additional objects and advantages thereof will be best understood from the following description when read in connection with the accompanying drawing, in which:

FIG. 1 is a diagrammatic, side elevational view of first embodiment of the invention wherein the headbox can be swiveled about a pivot which extends through the discharge slice of the paper stock discharge nozzle; and FIG. 2 is a similar view of another embodiment of the invention wherein the headbox is pivotable about a pivot that is situated in the center of the headbox feed pipe.

Referring now to the drawing and, in fact, to both figures thereof, there is shown therein a headbox 1 having a discharge nozzle 2 with a discharge slice or outlet 3 from which there issues a jet 4 of paper stock which impinges on a fourdrinier wire or screen 6 running over a breast roll 5. The paper stock or fiber suspension is fed to the headbox 1 through a feed pipe 7 extending at right angles to the longitudinal direction of the papermaking machine. The headbox 1 rests on two pivotably disposed base members 8 and 9 which, in turn, are supported by wedge members 10 and 11, each adjustable in the longitudinal direction of the machine or forward or rearward of the stock feed direction or jet 4 from the nozzle 2. Engaging threadedly in the two wedge members 10 and 11 is a common threaded spindle having opposite pitches in the respective regions of the two wedge members.

In the embodiment of the invention shown in FIG. 1, the headbox assembly includes stops 13 and 14, respectively engaging the sides of the headbox 1, the stops 13 and 14 being disposed on respective imaginary circles having a center that is located in the discharge slice 3 of discharge nozzle 2.

When the threaded spindle 12 is turned, the headbox 1 is raised or lowered by the wedge members 10 and 11, the differing wedge angles of the wedge members 10 and 11 causing the headbox 1 to swivel about the established pivot (discharge slice 3).

The paper stock jet 4 is also caused to swivel thereby, and impinges on the wire or screen 6 at a different angle.

The embodiment of the invention shown in FIG. 2 includes stops 23 and 24 for lateral guidance of the headbox 1, the stops 23 and 24 being located on imaginary circles, shown partly in phantom, which have a common rotary center that is situated in the center of feed pipe 7. Upon adjustment of the threaded spindle 12, the headbox 1, guided by the stops 23 and 24, is swiveled about a pivot center as a result of the differing wedge angles or surface inclination of the wedge members 10 and 11, the pivot center coinciding with the longitudinal axis of the feed pipe 7. This permits the feed pipe 7 outside the machine to be of an entirely rigid construction so that only a rotatable intermediate pipe section, such as a flange connection is required.

Since only extremely short distances are required to adjust the stock jet 2, it is possible to make the stops straight or erect since inaccuracies resulting during adjustment are negligibly small.

If, for example, according to the embodiment shown in FIG. 2, the discharge nozzle 2 is to be lowered, from the position thereof shown in full lines in FIG. 2, onto the wire or screen 6, there results a swivel angle $\alpha$ defined by the imaginary or phantom limit lines A and B extending from the pivot, i.e. center of the feed pipe 7. With respect to the two wedge members 10 and 11, this provides an inclination which, for the same adjustment in the longitudinal direction, corresponds to the mutual spacing between the limit lines A and B at the points I and II.

The headbox 1 may be provided with roller guides 13*a*, 14*a* and 23*a*, 24*a* at the locations correlated to the guide stops 13, 14 and 23, 24 respectively, thereby considerably reducing friction during adjustment of the headbox.

I claim:

1. Headbox assembly for a papermaking machine provided with a wire screen through which water from wet paper stock drains, the assembly comprising a headbox having a discharge nozzle for a jet of the paper stock, at least one forward and one rearward wedge member as viewed in feed direction of the stock jet from the discharge nozzle, said wedge members underlying said headbox and having respective wedge surfaces of different inclination, respective base members pivotally supporting said headbox and supportingly engaged by said wedge members respectively, and a threaded spindle whereon said wedge members are mounted in common, said spindle being actuable for adjusting the position of said wedges forward and rearward of said stock feed direction and accordingly of said headbox whereby said discharge nozzle thereof is adjustable relative to the wire screen of the machine.

2. Headbox assembly according to claim 1 including guide stop means guidingly supporting said headbox for bracing the same against adjusting forces applied thereto.

3. Headbox assembly according to claim 1, wherein the respective inclinations of said surfaces of said wedge members and the pitch of respective sections of said threaded spindle associated with said wedge members are in different directions.

4. Headbox assembly according to claim 2, wherein said guide stop means comprises at least one guide stop member having a surface defining a peripheral area disposed about a pivot center for said headbox, the location of said peripheral area being dependent at least partly on the inclinations of said surfaces of said wedge members.

5. Headbox assembly according to claim 4 comprising feed means for said paper stock connected to said headbox and having a longitudinal axis, said pivot center coinciding with said longitudinal axis of said feed means.

* * * * *

UNITED STATES PATENT AND TRADEMARK OFFICE

CERTIFICATE OF CORRECTION

PATENT NO. : 3,944,465
DATED : March 16, 1976
INVENTOR(S) : KARL WOLF

It is certified that error appears in the above-identified patent and that said Letters Patent are hereby corrected as shown below:

In the heading to the printed specification, lines 5, 6 and 7, "Assignee: E. I. DuPont de Nemours and Company, Heidenheim (Brenz), Germany" should read --J. M. Voith GmbH, Heidenheim/Brenz, Germany--.

Signed and Sealed this

Twenty-seventh Day of July 1976

[SEAL]

*Attest:*

RUTH C. MASON
*Attesting Officer*

C. MARSHALL DANN
*Commissioner of Patents and Trademarks*